US009384620B1

(12) United States Patent
Chang

(10) Patent No.: US 9,384,620 B1
(45) Date of Patent: Jul. 5, 2016

(54) VENDING MACHINE HAVING MECHANISMS FOR EXECUTING LOCKING, INDEXING AND DISPENSING OPERATIONS

(71) Applicant: Kil Jae Chang, Anyang (KR)

(72) Inventor: Kil Jae Chang, Anyang (KR)

( * ) Notice: Subject to any disclaimer, the term of this patent is extended or adjusted under 35 U.S.C. 154(b) by 80 days.

(21) Appl. No.: 14/544,180

(22) Filed: Dec. 5, 2014

Related U.S. Application Data

(60) Provisional application No. 61/963,860, filed on Dec. 16, 2013.

(51) Int. Cl.
*G07F 11/54* (2006.01)

(52) U.S. Cl.
CPC ..... *G07F 11/54* (2013.01)

(58) Field of Classification Search
CPC ..... G07F 11/54
See application file for complete search history.

(56) References Cited

U.S. PATENT DOCUMENTS

| | | | |
|---|---|---|---|
| 1,347,558 | A | 7/1920 | Simon |
| 2,990,084 | A | 6/1961 | Probasco |
| 7,182,219 | B2 | 2/2007 | Chang |
| 7,798,362 | B1 | 9/2010 | Chang |
| 2005/0082308 | A1 | 4/2005 | Simson |
| 2013/0186907 | A1 | 7/2013 | Striebel |

*Primary Examiner* — Leslie A Nicholson, III
*Assistant Examiner* — Ayodeji Ojofeitimi
(74) *Attorney, Agent, or Firm* — John R. Flanagan

(57) ABSTRACT

A vending machine includes a dispensing head, stationary shelf, and integrated mechanism. By turning an actuation mechanism handle the dispensing head rotates through a dispensing cycle delivering a lowermost container of one of a plurality of container stacks of a rotatable carousel off the dispensing head to a temporary position on the shelf below a dispensing opening of a hopper and therefrom to a discharge location accessible at the machine exterior. The integrated mechanism is disposed on a top cover, coupled both to an assembly rod and the carousel, and operable through an oscillatory rotational motion to tighten or loosen a clamping force applied to both secure the top cover on an open top of an outer enclosure while enabling rotation of the carousel to place a selected one of the container stacks at a dispensing position overlying the dispensing opening of the hopper and the dispensing head.

20 Claims, 6 Drawing Sheets

VENDING MACHINE HAVING MECHANISMS FOR EXECUTING LOCKING, INDEXING AND DISPENSING OPERATIONS

This patent application claims the benefit of U.S. provisional application No. 61/963,860 filed Dec. 16, 2013. The disclosure of this provisional application is hereby incorporated herein by reference thereto.

BACKGROUND OF THE INVENTION

1. Field of the Invention

The present invention generally relates to vending machines for single serve beverage cartridge containers and, more particularly, is concerned with such type of a vending machine having mechanisms for executing locking, indexing and dispensing operations so as to facilitate efficient handling of these types of cartridge containers.

2. Description of the Prior Art

A single serve beverage market has grown up around the use of containers in pod, capsule or cartridge form that hold single serve beverage ingredients, such as for coffee, and are intended to be received in automatic machines, such as specialized coffee brewing machines, to brew and dispense a single cup of coffee in a few minutes. These cartridge containers are generally cup-shaped, with a truncated conical side wall gradually tapering outward from a bottom to a top end. The side wall at the bottom end is closed by a substantially flat bottom wall, while at the top end the side wall defines a circular access opening usually larger in diameter than the bottom wall. The side wall at the top end also usually has an annular-shaped lip protruding radially outwardly from the side wall and surrounding the access opening and a lid sealed upon the lip so as to overlie and close the access opening. These cartridge containers may enclose other features that facilitate the brewing operation in the specialized machines. Additionally, these cartridge containers may contain other types of product ingredients unrelated to single serve beverage ingredients.

Recently, interest has stirred in the vending machine market to develop an approach that is adapted to bulk store the cartridge containers with beverage ingredients in different flavors so as to allow users to be able to select between the different flavors and then to singly dispense a single cartridge container corresponding to the user's selection. One approach to bulk storage and selective dispensing of these cartridge containers one at a time is that of the vending machine disclosed in U.S. Patent Application Publication No. 2013/0186907, published Jul. 25, 2013.

SUMMARY OF THE INVENTION

The present invention provides an alternative approach to bulk storage and selective dispensing of these cartridge containers one at a time. The vending machine of the present invention has mechanisms for executing locking, indexing and dispensing operations of the machine in a manner that facilitates efficient handling of these types of cartridge containers.

Accordingly, in one aspect the present invention provides a vending machine which includes a hopper, a container storage carousel, a dispensing mechanism, and an actuation mechanism. The hopper has a central platform and a dispensing opening defined therein. The container storage carousel is disposed upon and extends above the central platform of the hopper and is rotatable about a first axis extending longitudinally of the carousel. The carousel has a plurality of tubular storage columns extending upright so as to define a plurality compartments containing multiple containers, one on top of another, in stacks therein. The columns are open at least at bottoms thereof and angularly spaced apart from one another in a circular row such that the container stacks in the columns rest on the central platform of the hopper except for one of the container stacks at a time that is placed at a dispensing position overlying the dispensing opening of the hopper as the carousel is rotated relative thereto about the first axis.

The dispensing mechanism is disposed below the dispensing opening of the hopper. The dispensing mechanism includes a rotatable dispensing head and a stationary shelf. The rotatable dispensing head has spaced apart outer and inner ends and a platform extending between and being attached to peripheral portions of the outer and inner ends such that the outer and inner ends define a second axis extending transversely to the first axis of the carousel and at least an outer central portion of the platform is offset laterally of the second axis and initially located at the dispensing opening of the hopper below and supporting the one container stack placed at the dispensing position overlying the dispensing opening. The stationary shelf has a horizontal portion disposed between the outer and inner ends of the dispensing head and extends substantially parallel to the second axis and the outer central portion of the platform such that the platform revolves about the horizontal portion of the stationary shelf as the dispensing head is rotated about the second axis. The dispensing head is rotatable through a dispensing cycle to deliver a lowermost container of the container stack of the column, being located at the dispensing position upon the dispensing head, initially off the dispensing head to a temporary position on the stationary shelf located below the dispensing opening of the hopper and finally therefrom to a discharge location accessible to exterior of the housing.

The actuation mechanism is disposed adjacent to the rotatable dispensing head of the dispensing mechanism. The actuation mechanism includes a rotatable actuator. The rotatable actuator is rotatable about the second axis and is coupled to the outer end of the rotatable dispensing head to rotate the dispensing head about the second axis and thereby revolve the platform about the second axis and the horizontal portion of the stationary shelf. The actuation mechanism also includes a device coupled to the rotatable actuator and being rotatable through an actuation cycle to cause the rotatable actuator, and thereby the platform of the dispensing head, to revolve about the second axis and the horizontal portion of the stationary shelf through a dispensing cycle and along a circular path that delivers a lowermost container of the container stack of the column, being located at the dispensing position on the outer central portion of the platform of the rotatable dispensing head, initially onto the horizontal portion of the stationary shelf and finally therefrom to an accessible discharge location.

In another aspect the present invention provides a vending machine which includes an upstanding housing, a hopper, an outer enclosure, a top cover, a container storage carousel, an assembly rod, an integrated indexing and clamping mechanism, a dispensing mechanism, and an actuation mechanism. The housing defines a hollow interior chamber and has an upper peripheral portion and a lower base portion. The hopper has a perimeter and a central platform, the hopper at its perimeter being stationarily mounted on the upper peripheral portion of the housing. The central platform of the hopper extends across the interior chamber of the housing and has a central hole and a dispensing opening defined therein between the perimeter of the hopper and the central hole of its central platform. The outer enclosure has open upper and lower edge portions. The outer enclosure is mounted stationarily at its lower edge portion on the perimeter of the hopper and extends upwardly therefrom to its upper edge portion. The top cover is disposed on and overlies the open upper edge portion of the outer enclosure so as to close the outer enclosure. The top cover has a central hole therein.

The carousel is disposed within the outer enclosure and rotatably mounted on and extends above the central platform of the hopper so as to be rotatable about a first axis extending longitudinally of the carousel. The carousel has upper and lower plates disposed in a spaced relationship to each other and a plurality of tubular storage columns extending upright between the upper and lower plates so as to define a plurality compartments receiving stacks of multiple containers therein being open at tops and bottoms of the columns. The carousel also has a central hole and a plurality of spaced apart openings defined radially outward from the central hole in each of the upper and lower plates. The columns are aligned with the openings and together with the aligned openings are angularly spaced apart from one another in a circular row such that the container stacks in the columns rest on the central platform of the hopper except for one of the container stacks at a time that is placed at a dispensing position overlying the dispensing opening of the hopper as the carousel is rotated relative thereto about the first axis. The assembly rod extends through the interior chamber of the housing, the central hole of the hopper, the carousel, and the central holes of the respective upper and lower plates of the carousel. The assembly rod at a lower end portion is secured centrally to the lower base of the housing and at a upper end portion extends through a central opening in the top cover.

The integrated indexing and clamping mechanism is disposed on the top cover and is coupled to the upper end portion of the assembly rod and to the rotatable carousel. The integrated mechanism has a plurality of yieldable bearings disposed on the top cover and operable through an incremental back-and-forth rotational motion to tighten or loosen the bearings against the top cover to clamp of the outer enclosure and the housing between the base of the housing and the top cover to thereby both secure the top cover on the open top of the outer enclosure while enabling rotation of the carousel relative to the top cover, outer enclosure and hopper about the first axis in order to place a selected one of the columns at the dispensing position overlying the dispensing opening of the hopper;

The dispensing mechanism is disposed below the dispensing opening of the hopper and includes a rotatable dispensing head and a stationary shelf. The dispensing head is rotatable through a dispensing cycle to deliver a lowermost container of the container stack of the column, being located at the dispensing position upon the dispensing head, initially off the dispensing head to a temporary position on the stationary shelf located below the dispensing opening of the hopper and finally therefrom to a discharge location accessible to exterior of the housing. The actuation mechanism is mounted to the housing adjacent to the dispensing head and is operable by turning a handle through an actuation cycle to cause the dispensing mechanism to operate through the dispensing cycle.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
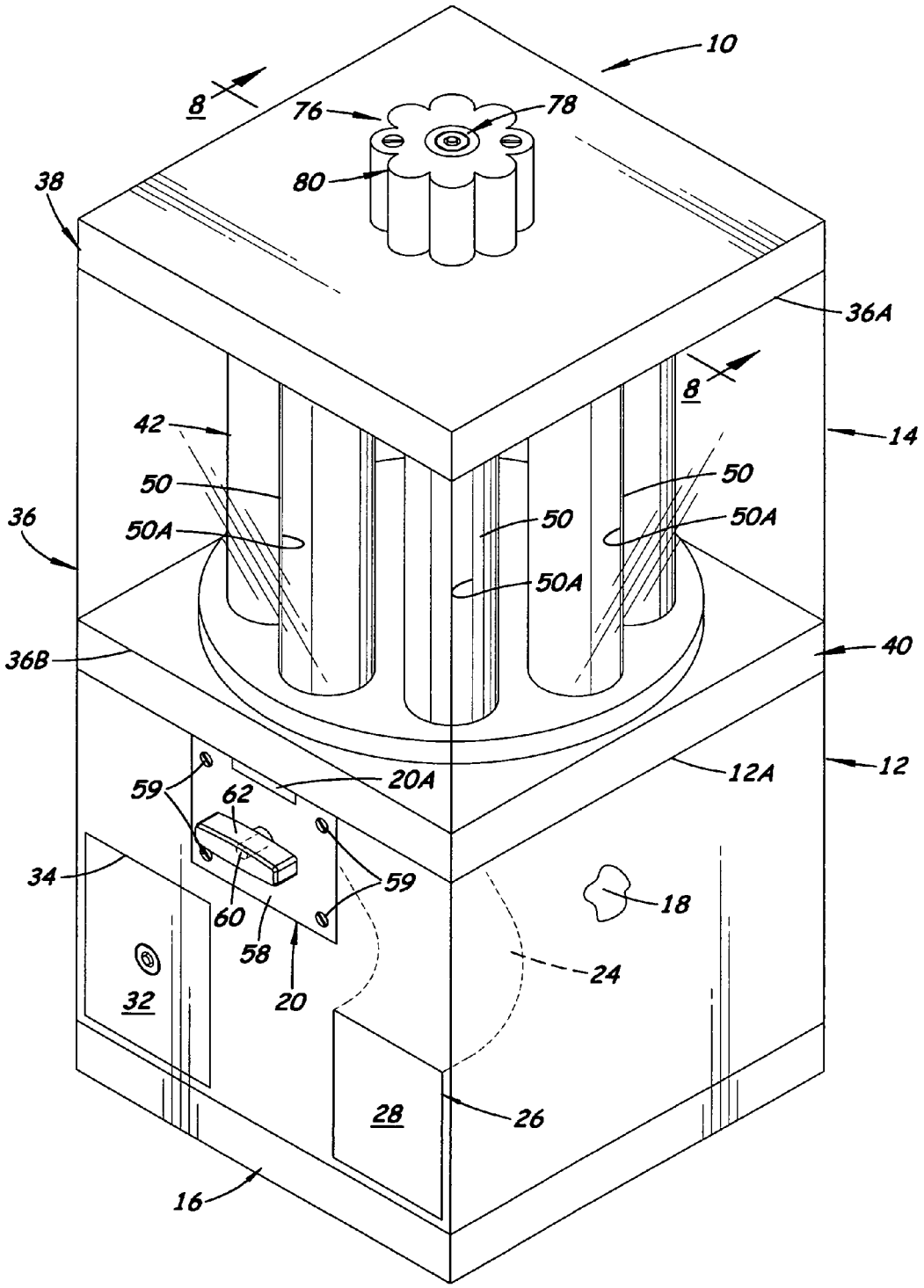
FIG. 1 is a front elevational view of an exemplary embodiment of a vending machine in accordance with the present invention.

Referring to the drawings, and particularly to FIGS. 1-5, there is illustrated an exemplary embodiment of a vending machine, generally designated 10, in accordance with the present invention. The vending machine 10 basically includes a housing 12 and a container storage and dispensing head 14 supported upon the housing 12. The housing 12 preferably, but not necessarily, is rectangular in configuration and has an open top end 12A, a closed bottom or base 16 and an interior chamber 18 therebetween. The vending machine 10 also includes a coin-operated actuation mechanism 20 mounted on the housing 12 at the exterior thereof and extending into the interior chamber 18 of the housing 12, a container dispensing mechanism 22 supported in the interior chamber 18 of the housing 12 and a delivery chute 24 supported in the interior chamber 18 of the housing 12 adjacent to the container dispensing mechanism 22. The delivery chute 24 is supported by the housing 12 to receive a container C from the dispensing mechanism 22 and deliver it to a final discharge station 26 having a pivotal access door 28 for removing the container. The vending machine 10 further includes an elongated assembly rod 30 extending vertically through the interior chamber 18 of the housing 12 for interconnecting the housing 12 and the container storage and dispensing head 14 together, and a lockable coin box 32 disposed in the interior chamber 18 of the housing 12 upon the closed bottom or base 16 thereof and, when unlocked, is removable through a side opening 34 in the housing 12.

The storage and dispensing head 14 of the vending machine 10 includes an outer transparent globe or enclosure 36 preferably, but not necessarily, rectangular in overall configuration, a removable top lid or cover 38 which fits upon an open upper end 36A of the enclosure 36 to close the same, and a top platform or hopper 40 below the outer enclosure 36 and removably supported on the open top end 12A of the housing 12 to close the same. The hopper 40 removably seats and closes the outer enclosure 36 at its lower open end 36B upon and within an interior peripheral ledge 41 formed in the hopper 40. The head 14 of the vending machine 10 also includes a generally cylindrical-shaped cartridge container storage magazine or carousel 42 disposed inside of the outer transparent enclosure 36, spaced below the removable top cover 38 and supported by the hopper 40 on a bottom wall 40A thereof. The hopper 40 also has a dispensing opening 44 defined in the bottom wall 40A of the hopper 40.

Figure 2:
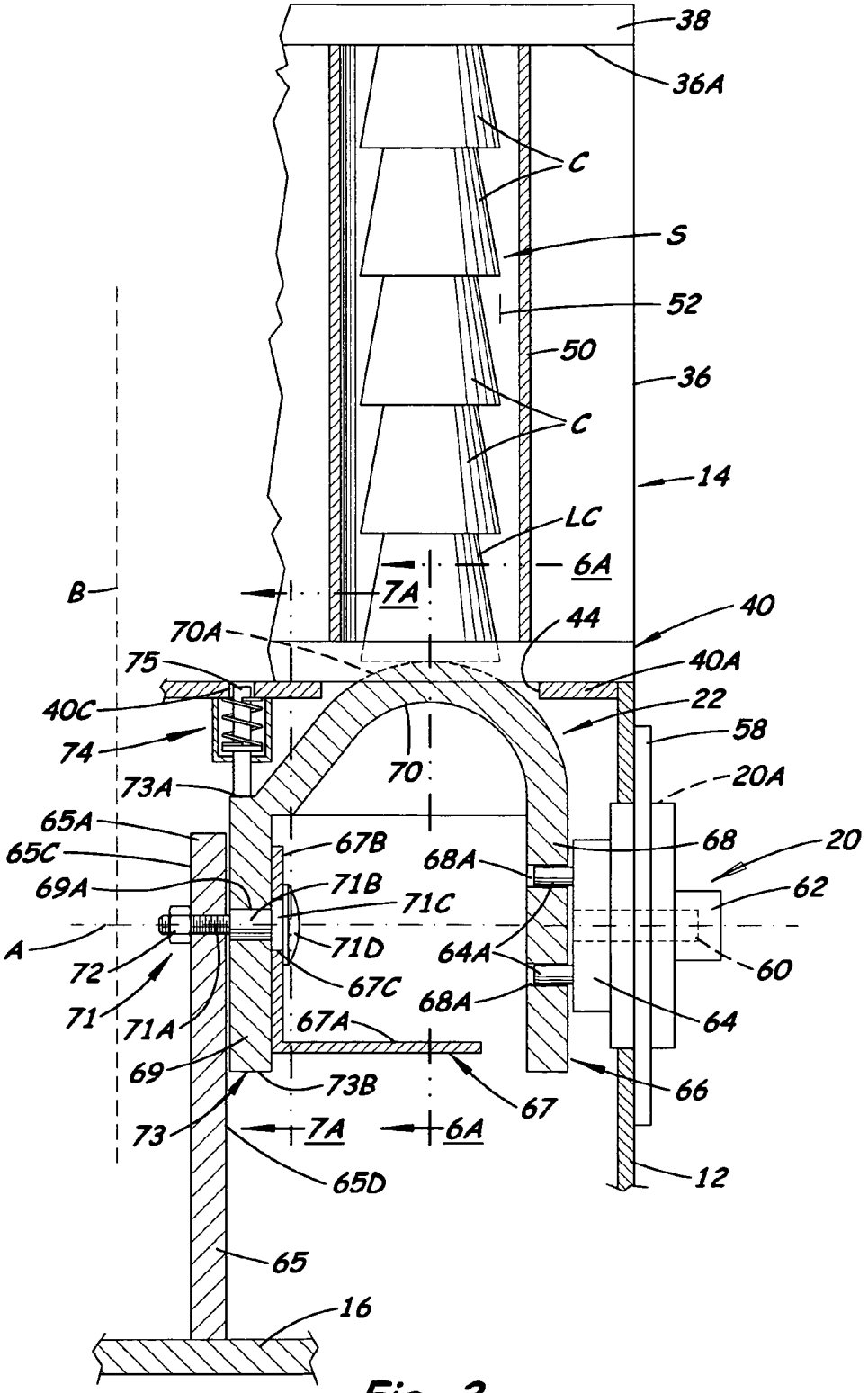
FIG. 2 is a fragmentary vertical sectional view of the machine showing actuation and dispensing mechanisms of the machine.
Figure 3:
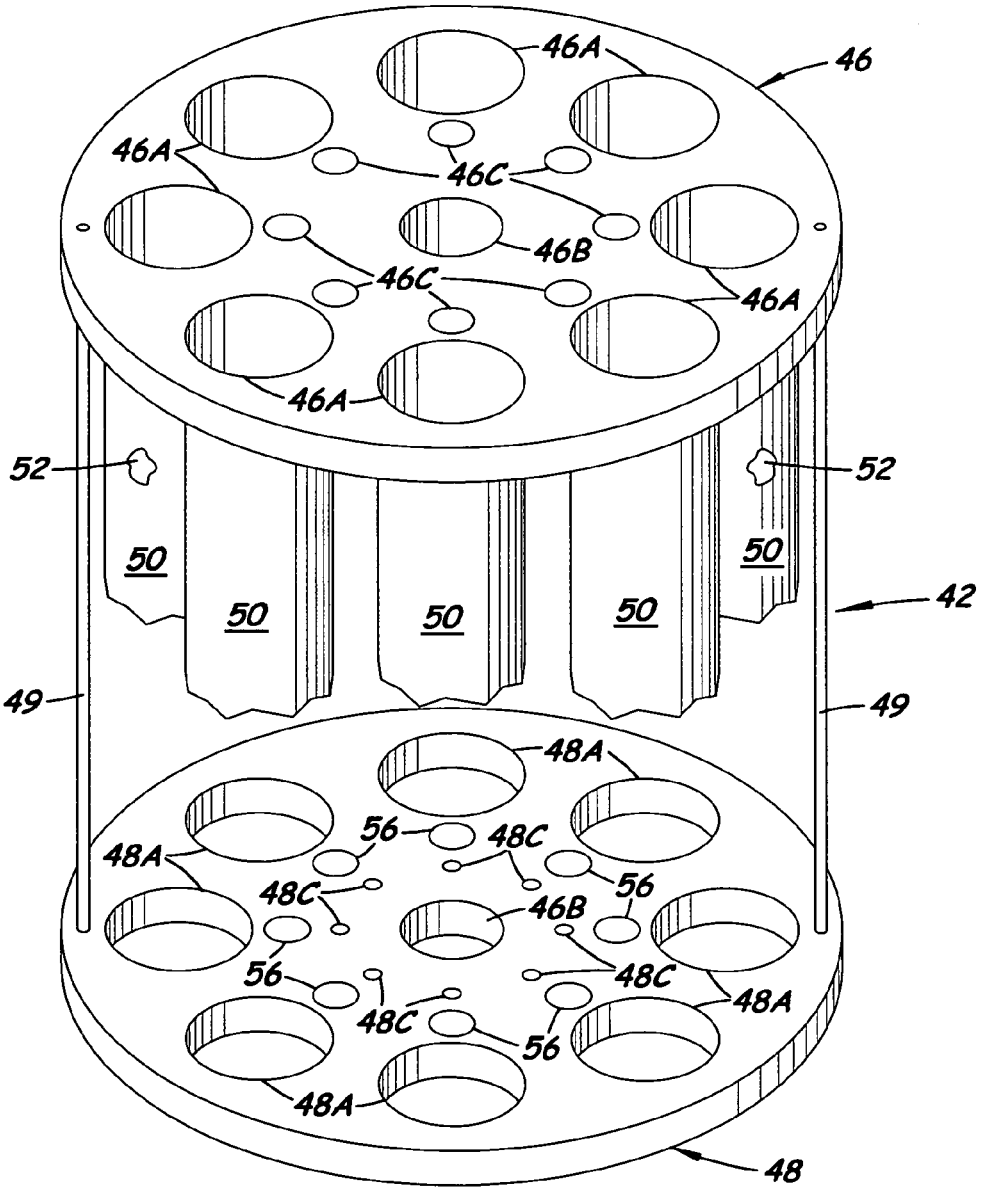
FIG. 3 is a perspective view of rotatable storage carousel of the machine showing in cutaway fashion a plurality of columns.

Referring now to FIGS. 1-3, the container storage carousel 42 has an overall generally cylindrical configuration and is made of a rigid material, such as a suitable plastic or metal. The carousel 42 includes upper and lower plates 46, 48, a plurality of elongated tie rods 49 extending between, and at their opposite ends fastened to, the peripheries of the upper and lower plates 46, 48 so as to hold the upper and lower plates 46, 48 in a desired spaced apart relationship to each other. The carousel 42 also includes a plurality of elongated tubular storage columns 50 extending between the upper and lower plates 46, 48 and defining container receiving and stacking compartments 52 therein. The carousel 42 has respective pluralities of openings 46A, 48A defined in the upper and lower plates 46, 48. The openings 46A, 48A of each plurality thereof are spaced apart angularly from each other in a circular arrangement adjacent to and spaced inwardly from the respective peripheries of the upper and lower plates 46, 48. The tubular storage columns 50 are mounted upright in relation to, and extend between, the upper and lower plates 46, 48. The tubular storage columns 50 are displaced angularly from each other in a substantially endless circular arrangement or row. The tubular storage columns 50, and respective compartments 52, and the openings 46A, 48A in the upper and lower plates 46, 48, are shown as being circular in configuration, although they may have other configurations, such as rectangular, for accommodating and holding therein a stack S of the cartridge containers C containing products or items, such as sealed cartridge containers C of ground coffee or the like, being correspondingly circular or rectangular in configuration and stacked upside down. The compartments 52 of the tubular storage columns 50 are open at the tops and bottoms of the columns 50 where they are matched with the openings 46A, 48A in the upper and lower plates 46, 48. The tubular storage columns 50 also may have elongated side slots 50A defined in outwardly facing side portions of the columns 50, opening into the compartments 52 and extending lengthwise between and opening at the open tops and bottoms of the column 50. The openings 46A of the upper plate 46 together with the open tops and side slots 50A of the storage columns 50 facilitate, by use of one's hand, and thus manually, placing and stacking of the cartridge containers C in the storage columns 50 whereas the openings 48A of the lower plate 48 together with the open bottom of the tubular storage columns 50 facilitate resting the stacks S of cartridge containers C at their lowermost container LC upon the bottom wall 40A of the hopper 40 and successive discharging of such cartridge containers C one at a time from the bottom of the stack S in a selected one of the tubular storage columns 50 through the dispensing opening 44 in the hopper 40.

Figure 4:
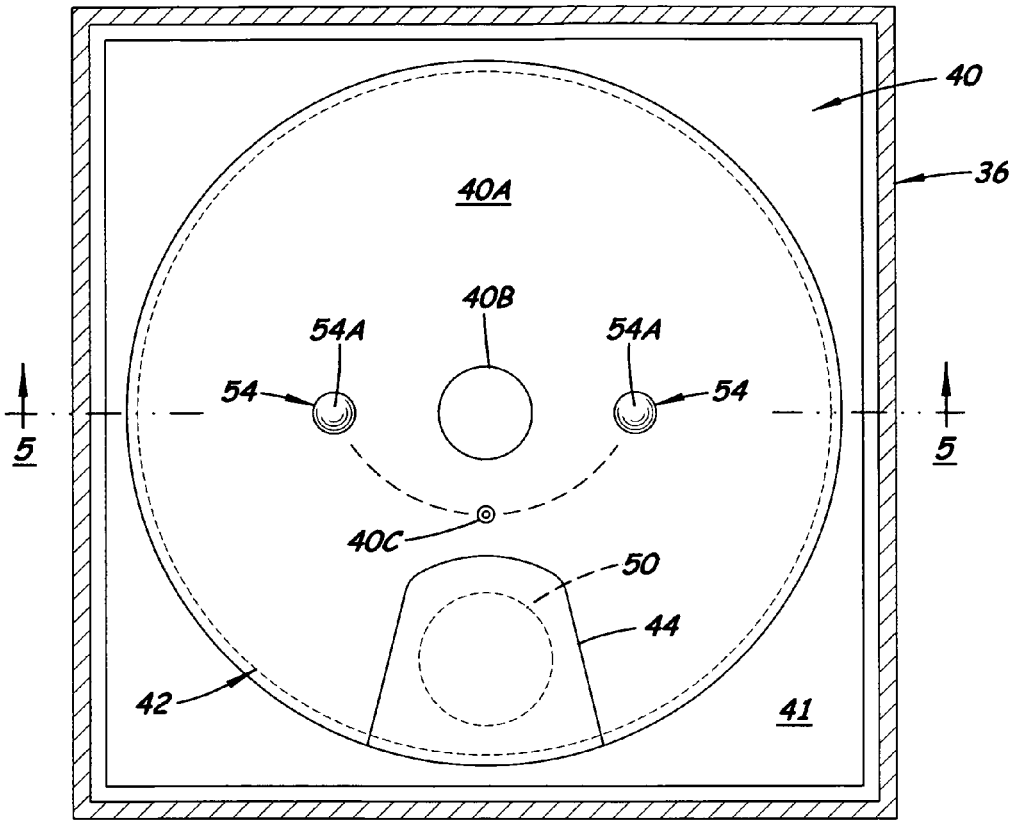
FIG. 4 is a top plan view of a hopper of the machine showing a dispensing opening therein over which is aligned one at a time a selected one of the storage columns of the storage carousel.
Figure 5:
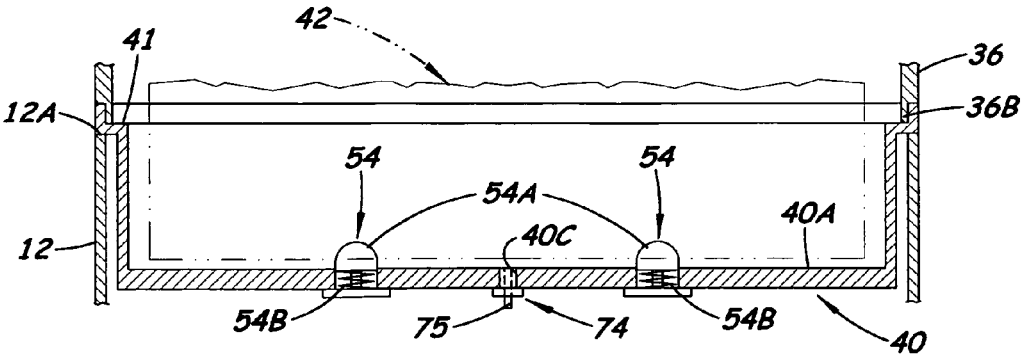
FIG. 5 is a vertical sectional view of the hopper on an upper end of a housing of the machine as seen along line 5-5 in FIG. 4.

Referring now to FIGS. 3-5, more particularly, the container storage carousel 42 at a central hole 48B in its lower plate 48 receives and rotatably mounts about an adjacent portion of the assembly rod 30 and mounts upon the bottom wall 40A of the hopper 40. Two spring-loaded alignment devices 54 are mounted to the bottom wall 40A of the hopper 40, being spaced outwardly from opposite sides of a central hole 40B in the hopper bottom wall 40A. The container storage carousel 42 has a plurality of opposing pairs of alignment holes 56 defined in the lower plate 48, spaced apart from one another and spaced between the openings 48A and the central hole 48B of the lower plate 48 of the carousel 42. A given one at a time of the plurality of opposing pairs of alignment holes 56 are capable of receiving the two alignment devices 54 on the bottom wall 40A of the hopper 40 so as to align a desired selected one of the tubular storage columns 50 over the dispensing opening 44 in the bottom wall 40A of the hopper 40, as seen in FIG. 2. Each of the alignment devices 54 has a rounded head 54A which is biased by a spring 54B to extend above the bottom wall 40A of the hopper 40 sufficiently to fit into the given one opposing pair of alignment holes 56. However, when the carousel 42 is manually rotated relative to the alignment devices 54 during selection of a different one of the tubular storage columns 50 to align over the dispensing opening 44, the rounded heads 54A of the alignment devices 54 will be pressed downward by the lower plate 48 of the carousel 42, compressing the respective springs 54B and retracting from the given one opposing pair of alignment holes 56 in the lower plate 48 of the carousel 42. Then, in response to the carousel 42 being rotated to bring a different selected tubular storage column 50 thereof into alignment over the dispensing opening 44 of the hopper 40, a biasing force is released due to extension of the compressed springs 54B causing upward movement of the alignment devices 54 so as to return their rounded heads 54A to their upwardly extended positions into another opposing pair of alignment holes 56 in the lower plate 48 of the carousel 42.

Referring again to FIGS. 1 and 2, the coin-operated actuation mechanism 20 is mounted to, and supported on the housing 12, by a mounting structure in the form of a plate 58 attached to the front of the housing 12 by a plurality of fasteners 59, such as conventional screws. In such position, the actuation mechanism 20 extends both within and without the housing 12 and defines a top coin deposit slot 20A and also include a central drive shaft 60 mounted through the mounting plate 58 for rotation about a transverse axis A extending in a generally orthogonal relation to a central longitudinal axis B defined by the elongated assembly rod 30 which is the rotational axis of the container storage carousel 42 of the storage and dispensing head 14. The actuation mechanism 20 further includes a handle 62 attached to an outer end of the drive shaft 60 for use by a user to rotate the drive shaft 60 and a wheel 64 attached to an inner end of the drive shaft 60 that incorporates a conventional one-way ratchet gear (not shown) so as to restrict rotation of the drive shaft 60 and handle 62 to a clockwise direction as viewed in FIG. 1. (The drive shaft 60 and wheel 64 together constitute a rotatable actuator rotated by turning the handle 62.) Thus, upon deposit by a user of a given coin or coins into the top coin deposit slot 20A of the actuation mechanism 20, the user may then turn the handle 62 clockwise thereby rotating the drive shaft 60 and wheel 64 through one revolution which is the same as one actuation cycle.

Referring now to FIG. 2, an upright support member 65 is fixedly mounted upon the base 16 of the housing 12 and is free-standing in the interior chamber 18 next to the coin box 32. The dispensing mechanism 22 includes a container dispensing head 66 supported by and extending between an upper end portion 65A of the upright support member 65 and a rear side of the wheel 64 of the actuation mechanism 20 for undergoing rotation with the rotatable actuator of the actuation mechanism 20 about the transverse axis A. The container dispensing head 66 of the dispensing mechanism 22 includes a pair of opposite outer and inner ends 68, 69 and a platform 70 having an inverted cradle shape and being rigidly attached to and extending between the outer and inner ends 68, 69. The platform 70 has an outer central portion 70A relatively flat in configuration and being disposed in a peripheral position offset laterally of and substantially parallel to the transverse axis A. The outer end 68 of the dispensing head 66 is fixedly coupled to the rotatable wheel 64 of the actuation mechanism 20 by a pair of bosses 64A that extend from the rear side of the rotatable wheel 64 into corresponding apertures 68A in the outer end 68 of the dispensing head 66.

The dispensing mechanism 22 also includes a container support shelf 67 stationarily supported by the upper end portion 65A of the upright support member 65, adjacent to the inner end 69 of the container dispensing head 66. The container support shelf 67 has a lower horizontal portion 67A disposed within the container dispensing head 66 between the outer and inner ends 68, 69 thereof at a stationary position spaced below and substantially aligned with the dispensing opening 44 of the hopper 40 and offset from, but substantially parallel to, the transverse axis A. The lower horizontal portion 67A of the stationary support shelf 67 merges, and extends in a cantilevered fashion, from a lower end of an upper vertical mounting portion 67B of the support shelf 67. The lower horizontal portion 67A extends toward, but terminates short of, the outer end 68 of the dispensing head 66. The lower horizontal portion 67A of the support shelf 67 serves as a horizontal surface for receiving and supporting thereupon a lowermost container LC as will be described hereinafter.

The dispensing head 66 at its inner end 69 and the support shelf 67 at the upper vertical portion 67B are supported by the upper end portion 65A of the upright support member 65 in conjunction with a fastener, such as a bolt 71 and a nut 72. The bolt 71 is installed so as to extend from the upper vertical portion 67B of the stationary support shelf 67, through the inner end 69 of the dispensing head 66, to the upper end portion 65A of the support member 65. The nut 72 may be threaded onto a threaded portion 71A at one end of the bolt 71 that extends from one side 65C of the upper end portion 65A of the upright support member 65 opposite from the inner end 69 of the dispensing head 66. The inner end 69 of the dispensing head 66 has a smooth cylindrical bore 69A therethrough that receives a smooth cylindrical middle portion 71B of the bolt 71, located next to its threaded end portion 71A, such that the bore 69A of the inner end 69 of the dispensing head 66 extends coaxial with the transverse axis A and enables the dispensing head 66 to rotate relative to and about the smooth cylindrical middle portion 71B of the bolt 71 and the transverse axis A. The bolt 71 also has a polygonal shaped portion 71C located between and adjacent to the middle portion 71B and an enlarged head 71D on the opposite end of the bolt 71. The polygonal shaped portion 71C of the fastener 71 fits within a similarly polygonal shaped opening 67C through the upper vertical portion 67B of the support shelf 67 which prevents rotation of the shelf 67, with the rotation of the dispensing head 66, relative to the upright support member 65. Tightening the nut 72 on the threaded end portion 71A of the bolt 71 causes an end of the middle portion 71B of the bolt 71, being of larger diameter than the threaded end portion 71A, to abut against the other side 65D of the of the upper end portion 65A of the upright support member 65 adjacent to the inner end 69 of the dispensing head 66 in a manner which affixes the bolt 71 to the upper end portion 65A of the upright support member 65 and retains the inner end 69 of the dispensing head 66 and the upper vertical portion 67B of the support shelf 67 between the enlarged head 71D of the bolt 71 and the upper end portion 65A of the upright support member 65.

Thus, when the handle 62 of the actuation mechanism 20 is turned clockwise through one revolution or actuation cycle, the dispensing head 66 undergoes clockwise rotation with the drive shaft 60 and wheel 64 (which together form the rotatable actuator) of the actuation mechanism 20, which revolves the platform 70 of the dispensing head 66 through one dispensing cycle along a circular path between upper and lower positions respectively located adjacent or proximate to and remote from the bottom wall 40A of the hopper 40. In the upper position, the outer central portion 70A of the platform 70 is substantially aligned with and spans the dispensing opening 44 in the bottom wall 40A of the hopper 40, as seen in FIGS. 2 and 4 so that the stacks S of cartridge containers C in the respective tubular columns 50 of the carousel 42 may smoothly slide one at a time to and from the bottom wall 40A of the hopper 40 across the outer central portion 70A of the platform 70 of the dispensing head 66 as the carousel 42 is rotated relative to the hopper 40 and the transparent outer enclosure 36.

Figure 7A:
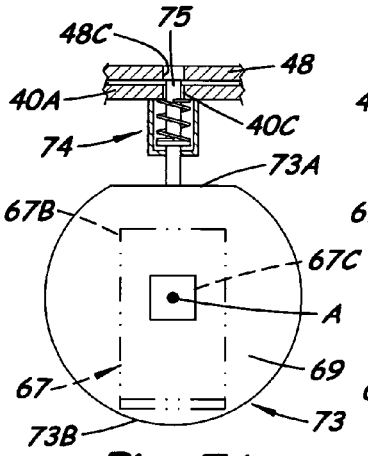
FIGS. 7A-7C are diagrammatic views of a spring-biased locking pin of a reciprocal locking mechanism and a peripheral cam surface on an inner end of the dispensing head of the machine dispensing mechanism at three sequential positions corresponding to those of the dispensing head in FIGS. 6A-6C.
Figure 7B:
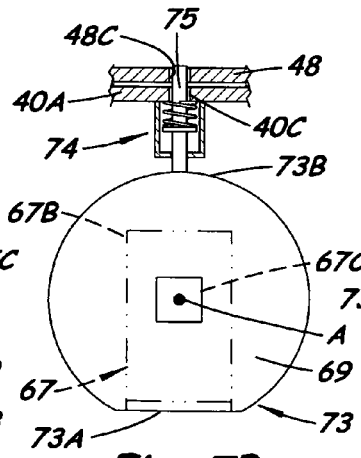
Figure 7C:
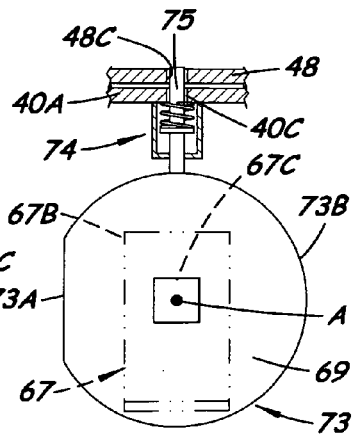

Furthermore, referring to FIGS. 2-5, the inner end 69 of the rotatable dispensing head 66 has a peripheral cam surface 73 thereabout which includes a flat portion 73A and a cylindrical portion 73B which, as explained in more detail below with reference to FIGS. 7A-7C, causes actuation of a reciprocal locking mechanism 74, being mounted to the underside of the hopper 40 in alignment with an aperture 40C in the bottom wall 40A of the hopper 40 adjacent to and spaced inwardly from the hopper dispensing opening 44. The reciprocal locking mechanism 74 has a spring-biased locking pin 75 which rides on the peripheral cam surface 73 on the inner end 69 of the rotatable dispensing head 66 and reciprocates between retracted and extended positions by its corresponding contact with the flat and cylindrical portions 73A, 73B of the peripheral cam surface 73. As can be seen in FIGS. 7A-7C, the flat portion 73A is much shorter in circumferential extent than the cylindrical portion 73B. Thus, the spring-biased locking pin 75 of the reciprocal locking mechanism 74 when in contact with the cylindrical portion 73B of the cam surface 73 is extended and cooperates, one at a time, with a given one of a plurality of holes 48C formed in the lower plate 48 of the carousel 42 in a circular arrangement disposed between the circular arrangement of alignment holes 56 and the central hole 48B of the lower plate 48 of the carousel 42 to lock the carousel 42 in a selected stationary position, with a selected one of the tubular columns 50 aligned with the dispensing opening 44 of the hopper 40, during the rotation of the dispensing head 66 by turning the handle 62 of the actuation mechanism 20. The reciprocal locking mechanism 74 may be substantially similar to the one shown and described in U.S. Pat. No. 7,182,219. This patent is by the inventor herein and its disclosure is hereby incorporated herein by reference.

Actuation of the reciprocal locking mechanism 74 prevents rotation of the container storage carousel 42 during the operation of the actuation mechanism 20 through one actuation cycle causing rotation of the dispensing head 66 through one dispensing cycle in which occurs the dropping of the one stack S of cartridge containers C placed at the dispensing position, after removal of its support on the outer central portion 70A of the platform 70 of the dispensing head 66 by revolving of the platform 70 of the dispensing head 66 away from the upper position adjacent to the dispensing opening 44 of the hopper 40. When the platform 70 revolves from the upper position to the lower position, the lowermost container LC of the one stack S is temporarily received on the lower horizontal portion 67A of the stationary support shelf 67 of the dispensing mechanism 22. When the platform 70 revolves from the lower position to the upper position, the lowermost container LC of the one stack S is tipped off the lower horizontal portion 67A of the support shelf 67 and into the delivery chute 24 (FIG. 1) by subsequent contact with the lowermost container LC by a leading edge portion 70B of the revolving platform 70. The delivery chute 24 routes the container to the discharge station 26 on the housing 12, as seen in FIG. 1. The discharge station 26 covered by the pivotal access door 28 may then be lifted by the user to gain access to the cartridge container C of merchandise dispensed by the operation of the vending machine 10.

Figure 6A:
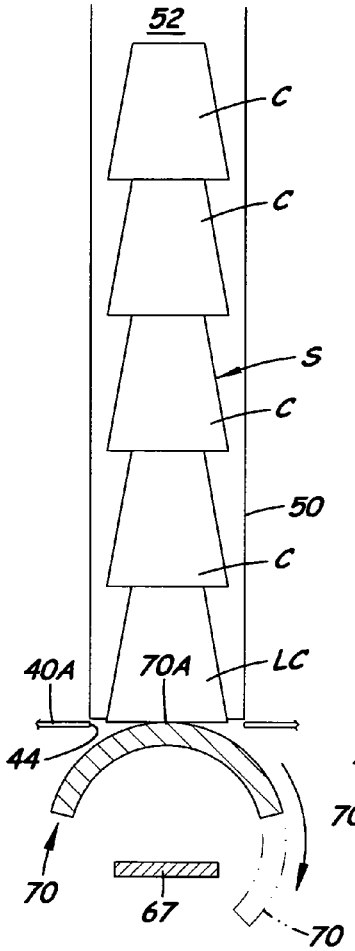
FIGS. 6A-6C are diagrammatic views of a bridge of a dispensing head of the machine dispensing mechanism at three sequential positions during a single actuation cycle.
Figure 6B:
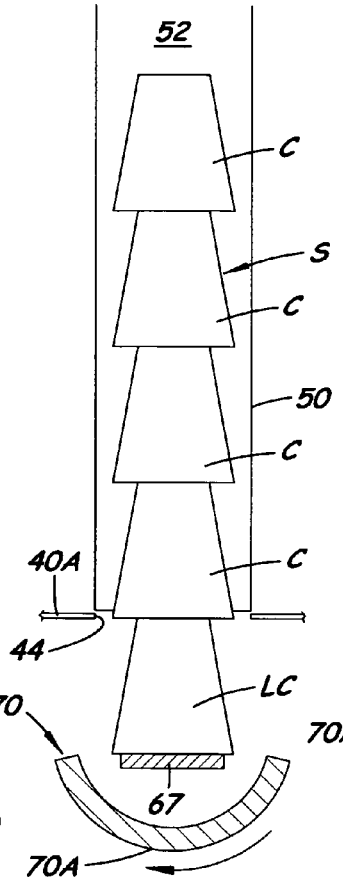
Figure 6C:
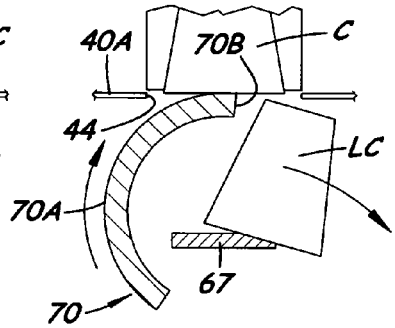

Referring now to FIGS. 6A-6C and 7A-7C, there are illustrated three sequential positions of the dispensing head 66 of the dispensing mechanism 22 and of the spring-biased locking pin 75 of the reciprocal locking mechanism 74 during one actuation cycle, which occurs as a result of depositing coin(s) into the coin deposit slot 20A and then turning the handle 62 through one revolution. FIG. 6A shows a lowermost one of the containers LC resting on the outer central portion 70A of the platform 70 of the dispensing head 66 with the platform 70 at an initial upper position at the start of the actuation and dispensing cycles before any turning of the handle 62 has occurred. FIG. 7A shows the locking pin 75 in a non-activated retracted position resting on the flat portion 73A of the peripheral cam surface 73 of the inner end 69 of the dispensing head 66 and disposed within the one aperture 40C (see also FIGS. 2 and 4) in the bottom wall 40A of the hopper 40 immediately above the locking pin 75. The top of the locking pin 75 is thus located below the level of any one of the plurality of holes 48C in the lower plate 48 of the carousel 42 corresponding to respective ones of the columns 50 holding the stacks S of containers C. In this non-activated position of the locking pin 75, and before turning of the handle 62 of the actuation mechanism 20, the carousel 42 may be rotated relative to the dispensing opening 44 of the hopper 40 until the desired one of the columns 50 holding the selected stack S of containers C is aligned over the dispensing opening 44 resting on the outer central portion 70A of the platform 70 of the dispensing head 66. Thereafter, the start of turning of the handle 62 in a clockwise direction, initiating the start of an actuation cycle, will cause rotation of the dispensing head 66 and thus revolving of its platform 70 away from its position underlying the hopper dispensing opening 44 toward the dashed line position in FIG. 6A and concurrently elevation or extension of the locking pin 75 against its spring bias into the aligned one of the holes 48C of the lower plate 48 of the carousel 42 to the locking position shown in FIG. 7B. The elevation of the locking pin 75 is caused by contact between the locking pin 75 and the cylindrical portion 73B of the cam surface 73 on the inner end 69 of the dispensing head 66, being shown in FIGS. 7A-7C. The cylindrical portion 73B of the peripheral cam surface 73, due to its greater radius than the flat portion 73A, lifts the locking pin 75 and maintains it extended into the selected one of the holes 48C of the lower plate 48 of the carousel 42, preventing any further rotation of the carousel. FIG. 6B shows the position of the container stack S and lowermost container LC after the platform 70 of the dispensing head 66 has revolved about 180° clockwise from the upper start position to an intermediate lower position, or through about half of an actuation cycle, such that the platform 70 of the dispensing head 66 is now clear of the lowermost container LC, thus permitting the stack S to drop down and only the lowermost container LC to rest on the lower horizontal portion 67A of the stationary support shelf 67 about and with respect to which the platform 70 of the dispensing head 66 is revolving. FIG. 6C shows the platform 70 of the dispensing head 66 after it has revolved from the intermediate lower portion toward the upper position through about three-quarters of an actuation cycle in which a leading end portion 70B of the platform 70 now underlies the stack S and has pushed or tipped the dispensed lowermost container LC off the stationary shelf 67 such that the container LC drops through the delivery chute 24 to the discharge station 26 (see FIG. 1). As seen in FIGS. 7B and 7C, the locking pin 75 is retained by the contact with the cylindrical portion 73B of the peripheral cam surface 73 inserted into the one hole 48C of the lower plate 48 of the carousel 42 until the dispensing head 66 has returned to its initial upper position, as seen in FIG. 6A, at the completion of the actuation cycle. Upon approaching the end of the actuation cycle, the flat portion 73A of the peripheral cam surface 73 on the inner end 69 of the dispensing head 66 is again brought under the locking pin 75, as shown in FIG. 7A, permitting its retraction in the direction of its spring bias.

Referring now to FIGS. 1 and 2, the assembly rod 30 extends through the head 14 (and thus through respective central holes 46B, 48B of the upper and lower plates 46, 48 of the carousel 42) and through the central hole 40B in the hopper 40 and is connected, such as by being threadably attached, at a lower end portion 30A to the base 16 of the housing 12 and connectible at an upper end portion 30B to the removable top cover 38 by operating an integrated indexing and clamping mechanism 76 (hereinafter for the sake of brevity referred to as the "integrated mechanism") fitted to the top cover 38. With the assembly rod 30 connected at its lower end 30A to the base 16 of the housing 12, by tightening a locking device 78 of the integrated mechanism 76, using only a key 79, against the top cover 38 via an indexing knob 80 of the integrated mechanism 76 interposed between the locking device 78 and the top cover 38, the outer enclosure 36 and hopper 40 become clamped between the base 16 of the housing 12 and the top cover 38 so as to hold the vending machine 10 in an assembled condition, while allowing the carousel 42 to be rotated relative to the hopper 40 and the top cover 38. The carousel 42 can be rotated by gripping and turning the indexing knob 80 of the integrated mechanism 76, being rotatable about the upper end 30B of the assembly rod 30, while the locking device 78 is tightened on the upper end portion 30B of the assembly rod 30 holding the vending machine 10 in the assembled condition. Loosening and removing only the locking device 78 permits removal of the top cover 38 from the vending machine 10 without removing the outer enclosure 36 or the carousel 42.

Figure 8:
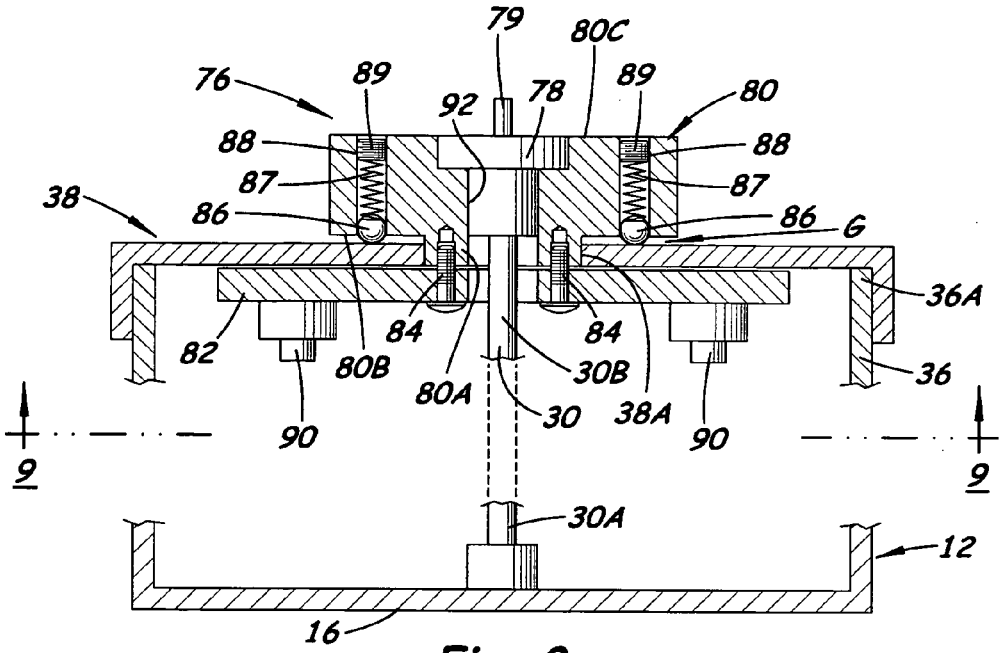
FIG. 8 is an enlarged vertical foreshortened sectional view of a base of the housing of the machine and of a top cover on an upper end of an outer enclosure of the machine taken along 8-8 in FIG. 1, showing the base and top cover interconnected by an assembly rod and also an integrated indexing and clamping mechanism on the top cover that allows for executing the locking of the top cover on the upper end of the outer enclosure of the machine while still allowing for rotation of the container storage carousel relative to the top cover, outer enclosure and housing of the machine.
Figure 9:
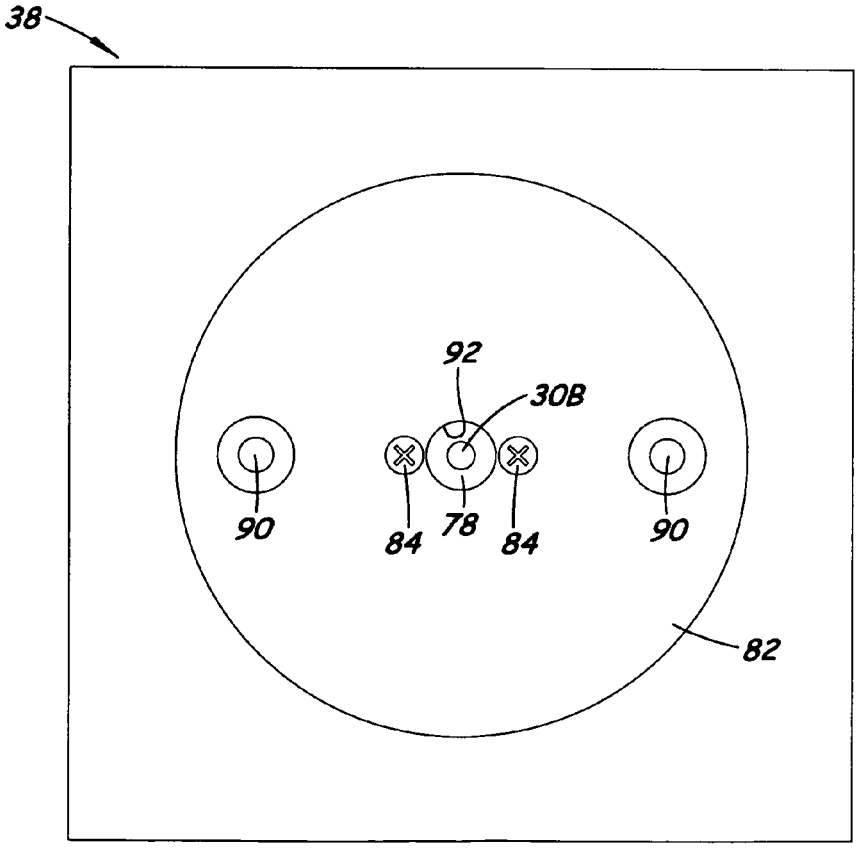
FIG. 9 is a bottom view of the integrated mechanism as seen along line 9-9 in FIG. 8.

Referring to FIGS. 8 and 9, the upper end 30B of the assembly rod 30 may be lockably secured against the top cover 38, for assembling and clamping the outer enclosure 36 between the housing 12 and the top cover 38, by actuating the locking device 78 using only the key 79. Both the locking device 78 and key 79 per se are the same as those used heretofore. Only now, the locking device 78 and key 79 are part of the integrated mechanism 76 that permits execution of several operations which heretofore were independently and separately executed. The integrated mechanism 76 allows for executing the locking of the top cover 38 onto the outer enclosure 36 and housing 12 while still allowing rotation of the interiorly-positioned storage carousel 42 for indexing the carousel 42 to bring different ones of its storage columns 50 into alignment over the dispensing opening 44 and with the outer central portion 70A of the platform 70 of the dispensing head 66 of the dispensing mechanism 22.

More particularly, in addition to the locking device 78, key 79 and indexing knob 80, the integrated mechanism 76 includes a coupling member in the form of a turntable 82 disposed below the top cover 38 and fixedly mounted by screws 84 to a lower annular hub 80A of the indexing knob 80 disposed through the central opening 38A of the top cover 38. The integrated mechanism 76 also includes a plurality of ball bearings 86, such as steel balls, disposed between a lower annular surface 80B of the indexing knob 80, surrounding the annular hub 80A thereof, and a top surface 38B of the top cover 38 encompassing the central opening 38A thereof. The plurality of ball bearings 86 are biased toward the top surface 38B of the top cover 38 by a plurality of springs 87 seated in a corresponding plurality of cavities 88 formed in the indexing knob 80 and held therein by a plurality of set screws 89 threaded into upper portions of the cavities 88 open at an upper annular surface 80C of the indexing knob 80. The cavities 88 are arranged spaced apart from one another in a circular row. The turntable 82 has at least a pair of bosses 90 fixedly mounted to the lower surface of the turntable 82 which match with various opposed pairs of the holes 46C of a plurality thereof located on opposite sides of the central hole 46B, and between the central hole 46B and the openings 46A, in the upper plate 46 of the carousel 42, which openings 46A match with the open tops of the columns 50 of the carousel 42, as seen in FIG. 3.

When the top cover 38 is placed onto the open upper end 36A of the outer enclosure 36, an incremental back-and-forth rotational motion can be applied to the indexing knob 80 so as to readily register the carousel holding bosses 90 with, and insert them into, one of the pairs of opposed holes 46C in the upper plate 46 of the carousel 42. Then, the locking device 78 can be inserted into a stepped central bore 92 in the indexing knob 80 and rotatably threaded onto the upper end 30B of the assembly rod 30 by inserting the key 79 in the locking device 78 and turning the key 79 relative to the locking device 78. This is done to also tighten the locking device 78 against the indexing knob 80 and apply clamping force downward through the indexing knob 80 onto the top cover 38 so as to clamp the cover top 38 over and against the upper end 36A of the outer enclosure 36. At this point, if the locking device 78 is tightened too much, the operator (and thus a user) may not be able to turn the indexing knob 80 to rotate or turn the carousel 42 in order to align a desired or selected one of the tubular columns 50 of the carousel 42 with the discharge opening 44 of the hopper 40. So the operator must turn the key 79 in reverse so as to un-tighten (or backoff) the clamping force of the locking device 78 applied through the indexing knob 80 against the top cover 38 just enough to allow the operator is able to easily turn the indexing knob 80. A small gap G of about 1 mm will be produced between the indexing knob 80 and top cover 38 at the point where sufficient downward force is being applied. At that point, the action of the spring biased ball bearings 86 will still impose sufficient clamping force upon the top cover 38 so as to continue to clamp it against the outer enclosure 36 so as to prevent lifting of the top cover 38 from off of the outer enclosure 36. Thus, in such manner, the integrated mechanism 76 allows for actuating the locking of the top cover 38 onto the outer enclosure 36 and housing 12 while allowing rotation of the interiorly-positioned storage carousel 42 for indexing the carousel 42 by employing the indexing knob 80 that integrates the locking device 78 therewith so as to bring different ones of its tubular storage columns 50 into alignment over the hopper dispensing opening 44 and with the dispensing head 66 while maintaining the top cover 38 firmly clamped onto the outside enclosure 36.

It is thought that the present invention and its advantages will be understood from the foregoing description and it will be apparent that various changes may be made thereto without departing from the spirit and scope of the invention or sacrificing all of its material advantages, the forms hereinbefore described being merely exemplary embodiments thereof.

What is claimed is:

1. A vending machine, comprising:

a hopper having a central platform and a dispensing opening defined therein;

a container storage carousel disposed upon and extending above said central platform of said hopper and being rotatable about a first axis extending longitudinally of said carousel, said carousel having a plurality of tubular storage columns extending upright so as to define a plurality compartments containing stacks of multiple containers therein, said columns being open at least at bottoms thereof and angularly spaced apart from one another in a circular row such that the container stacks in said columns rest on said central platform of said hopper except for one of the container stacks at a time that is placed at a dispensing position overlying said dispensing opening of said hopper as said carousel is rotated relative thereto about said first axis;

a dispensing mechanism disposed below said dispensing opening of said hopper, said dispensing mechanism including a rotatable dispensing head having spaced apart outer and inner ends and a platform extending between and being attached to peripheral portions of said outer and inner ends such that said outer and inner ends define a second axis extending transversely to said first axis of said carousel and at least an outer central portion of said platform is offset laterally of said second axis and initially located at an upper position adjacent to said dispensing opening of said hopper below and supporting the one container stack placed at said dispensing position overlying said dispensing opening, and a stationary shelf having a horizontal portion disposed between said outer and inner ends of said dispensing head and extending substantially parallel to said second axis and said platform such that said platform revolves about said horizontal portion of said stationary shelf as said dispensing head is rotated about said second axis; and an actuation mechanism disposed adjacent to said rotatable dispensing head of said dispensing mechanism and including a rotatable actuator rotatable about said second axis and being coupled to said outer end of said rotatable dispensing head to rotate said dispensing head about said second axis and thereby revolve said platform about said second axis and said horizontal portion of said stationary shelf, and a device coupled to said rotatable actuator and being rotatable through an actuation cycle to cause said rotatable actuator, and thereby said platform of said dispensing head, to revolve about said second axis and said horizontal portion of said stationary shelf through a dispensing cycle and along a circular path that delivers a lowermost container of the container stack of the one column, being located at said dispensing position on said outer central portion of said platform of said rotatable dispensing head, initially off said outer central portion of said platform and onto said horizontal portion of said stationary shelf and finally therefrom to an accessible discharge location.

2. The vending machine of claim 1 wherein said platform of said dispensing head, during start of said dispensing cycle, is revolvable along said circular path about said horizontal portion of said stationary shelf away from said initial upper position spaced above said horizontal portion of said stationary shelf and disposed adjacent to said dispensing opening of said hopper in which said outer central portion of said platform when at said upper position substantially spans said dispensing opening and supports the container stack in the one column in a spaced relationship above said horizontal portion of said stationary shelf.

3. The vending machine of claim 2 wherein said platform of said dispensing head, during continuance of said dispensing cycle, is revolvable along said circular path about said horizontal portion of said stationary shelf through an intermediate lower position spaced below said horizontal portion of said stationary shelf and remote from said dispensing opening of said hopper in which said outer central portion of said platform when approaching said intermediate lower position is moving more away from said dispensing opening, thereby allowing the container stack in the one column to drop relative to said dispensing opening of said hopper toward said horizontal portion of said stationary shelf such that only a lowermost one of the containers in the container stack is supported upon said horizontal portion of said stationary shelf and below said dispensing opening of said hopper.

4. The vending machine of claim 3 wherein said platform of said dispensing head, during completion of said dispensing cycle, is revolvable along said circular path about said horizontal portion of said stationary shelf and back toward said upper position in which a leading end of said platform when approaching said initial upper position is making contact with the lowermost container on said horizontal portion of said stationary shelf, thereby tipping the lowermost container off said horizontal portion of said stationary shelf toward the discharge location as said platform reaches said initial upper position ending said dispensing cycle.

5. The vending machine of claim 1 wherein said dispensing head on said inner end thereof has a peripheral cam surface defining circumferentially disposed cylindrical and flat surface portions.

6. The vending machine of claim 5 further comprising:

a locking mechanism on an underside of said central platform of said hopper and engaged with said peripheral cam surface of said dispensing head such that when said locking mechanism is engaged with said cylindrical surface portion of said peripheral cam surface said locking mechanism prevents rotation of said carousel relative to said dispensing opening in said hopper and when said locking mechanism is engaged with said flat surface portion of said peripheral cam surface said locking mechanism allows rotation of said carousel relative to said dispensing opening in said hopper.

7. The vending machine of claim 6 wherein said locking mechanism includes a locking pin being reciprocally mounted on said underside of said central platform of said hopper and having one end disposed at a hole in said central platform of said hopper, said locking pin also being biased such that at an opposite end said locking pin maintains engagement with said peripheral cam surface of said dispensing head so as to reciprocate between a retracted position in which said locking pin, at said opposite end being engaged with said flat surface portion of said peripheral cam surface, at said one end is disposed out of contact with said carousel, thereby allowing rotation of said carousel relative to said dispensing opening in said hopper, and an extended position in which said locking pin, at said opposite end being engaged with said cylindrical surface portion of said peripheral cam surface, at said one end is disposed in contact with said carousel, thereby preventing rotation of said carousel relative to said dispensing opening in said hopper.

8. The vending machine of claim 1 further comprising:

an outer enclosure surrounding said carousel and stationarily disposed relative to said rotatable carousel;

a top cover disposed on and overlying an open top of said outer enclosure so as to close said outer enclosure; and an integrated indexing and clamping mechanism disposed on said top cover and being coupled to said rotatable carousel, said integrated mechanism including a plurality of yieldable bearings disposed on said top cover and being operable through an incremental back-and-forth rotational motion to tighten or loosen said bearings against said top cover to both secure said top lid on said open top of said outer enclosure while enabling rotation of said carousel relative to said top cover, said outer enclosure and said hopper about said first axis in order to place a selected one of said columns at said dispensing position overlying said dispensing opening of said hopper.

9. The vending machine of claim 8 wherein said integrated indexing and clamping mechanism further including:

an indexing knob disposed on said top cover and having a central portion extending through a central opening in said top cover so as to mount said indexing knob for undergoing rotation relative to said top cover; and a coupling member disposed below said top cover and affixed to said central portion of said indexing knob for undergoing rotation therewith, said coupling member being coupled to said carousel such that said carousel is rotated with rotation of said indexing knob and said coupling member when said reciprocal locking pin of said locking mechanism is at said retracted position relative to said carousel.

10. A vending machine, comprising:

an upstanding housing defining a hollow interior chamber and having an upper peripheral portion and a lower base portion;

a hopper having a perimeter and a central platform, said hopper at its perimeter being stationarily mounted on said upper peripheral portion of said housing, said central platform of said hopper extending across said interior chamber of said housing and having a central hole and a dispensing opening defined therein between said perimeter of said hopper and said central hole of said central platform thereof;

an outer enclosure having open upper and lower edge portions, said outer enclosure being mounted stationarily at said lower edge portion on said perimeter of said hopper and extending upwardly therefrom to said upper edge portion;

a top cover disposed on and overlying said open upper edge portion of said outer enclosure so as to close said outer enclosure, said top cover having a central opening therein;

a storage carousel disposed within said outer enclosure and being rotatably mounted on and extending above said central platform of said hopper so as to be rotatable about a first axis extending longitudinally of said carousel, said carousel having upper and lower plates disposed in a spaced relationship to each other and a plurality of tubular storage columns extending upright between said upper and lower plates so as to define a plurality compartments, receiving stacks of multiple containers therein, being open at tops and bottoms of said columns, said carousel also having a central hole and a plurality of spaced apart openings defined radially outward from said central hole in each of said upper and lower plates, said columns being aligned with said openings, said columns together with said aligned openings being angularly spaced apart from one another in a circular row such that the container stacks in said columns rest on said central platform of said hopper except for one of the container stacks at a time that is placed at a dispensing position overlying said dispensing opening of said hopper as said carousel is rotated relative thereto about said first axis;

an assembly rod extending through said interior chamber of said housing, said central hole of said hopper, said carousel, and said central holes of said respective upper and lower plates of said carousel, said assembly rod at a lower end portion being secured centrally to said lower base of said housing and at a upper end portion extending through a central hole in said top cover;

an integrated indexing and locking mechanism disposed on said top cover and being coupled to said rotatable carousel and said upper end portion of said assembly rod, said integrated mechanism including a plurality of yieldable bearings disposed on said top cover and being operable through an incremental back-and-forth rotational motion to tighten or loosen said bearings against said top cover and clamping of said outer enclosure and said housing between said base of said housing and said top cover to thereby both secure said top cover on said open top of said outer enclosure while enabling rotation of said carousel relative to said top cover, said outer enclosure and said hopper about said first axis in order to place a selected one of said columns at said dispensing position overlying said dispensing opening of said hopper;

a dispensing mechanism disposed below said dispensing opening of said hopper and including a rotatable dispensing head and a stationary shelf, said dispensing head being rotatable through a dispensing cycle to deliver a lowermost container of the container stack of the column, being located at the dispensing position upon said dispensing head, initially off said dispensing head to a temporary position on said stationary shelf spaced below said dispensing opening of said hopper and finally therefrom to a discharge location accessible to exterior of said housing; and an actuation mechanism mounted to said housing adjacent to said dispensing head and being operable by turning a handle through an actuation cycle to cause said dispensing mechanism to operate through said dispensing cycle.

11. The vending machine of claim 10 wherein said integrated indexing and clamping mechanism further includes an indexing knob disposed on said top cover and having a central portion extending through a central opening in said top cover so as to mount said indexing knob for undergoing rotation relative to said top cover.

12. The vending machine of claim 11 wherein said integrated indexing and clamping mechanism further includes a coupling member disposed below said top cover and affixed to said central portion of said indexing knob for undergoing rotation therewith, said coupling member being coupled to said carousel such that said carousel is rotated with rotation of said indexing knob and said coupling member when said reciprocal locking pin of said locking mechanism is at said retracted position relative to said carousel.

13. The vending machine of claim 12 wherein said integrated indexing and clamping mechanism further includes a locking device inserted into a stepped central bore in said indexing knob and rotatably threadable onto said upper end portion of said assembly rod adjacent to said central hole of said top cover.

14. The vending machine of claim 13 wherein said integrated indexing and clamping mechanism further includes a key insertable into and turnable relative to said locking device to apply said incremental back-and-forth rotational motion to tighten or loosen said yieldable bearings against said top cover and thereby clamping force applied by said indexing knob via said yieldable bearings onto said top cover so as to clamp said outer enclosure and said housing between said base of said housing and said top cover to thereby both secure said top cover on said open top of said outer enclosure while enabling rotation of said carousel relative to said top cover.

15. The vending machine of claim 10 wherein said rotatable dispensing head has spaced apart outer and inner ends and a platform extending between and being attached to peripheral portions of said outer and inner ends such that said outer and inner ends define a second axis extending transversely to said first axis of said carousel defined by said assembly rod.

16. The vending machine of claim 15 wherein said platform has at least an outer central portion offset laterally of said second axis and initially located at an upper position adjacent to said dispensing opening of said hopper below and supporting the one container stack placed at said dispensing position overlying said dispensing opening.

17. The vending machine of claim 16 wherein said stationary shelf has a horizontal portion disposed between said outer and inner ends of said dispensing head and extending substantially parallel to said second axis and said platform such that said platform revolves about said horizontal portion of said stationary shelf as said dispensing head is rotated about said second axis.

18. The vending machine of claim 15 wherein said dispensing head on said inner end thereof has a peripheral cam surface defining circumferentially disposed cylindrical and flat surface portions.

19. The vending machine of claim 18 further comprising:

a locking mechanism on an underside of said central platform of said hopper and engaged with said peripheral cam surface of said dispensing head such that when said locking mechanism is engaged with said cylindrical surface portion of said peripheral cam surface said locking mechanism prevents rotation of said carousel relative to said dispensing opening in said hopper and when said locking mechanism is engaged with said flat surface portion of said peripheral cam surface said locking mechanism allows rotation of said carousel relative to said dispensing opening in said hopper.

20. The vending machine of claim 19 wherein said locking mechanism includes a locking pin being reciprocally mounted on said underside of said central platform of said hopper and having one end disposed at a hole in said central platform of said hopper, said locking pin also being biased such that at an opposite end said locking pin maintains engagement with said peripheral cam surface of said dispensing head so as to reciprocate between a retracted position in which said locking pin, at said opposite end being engaged with said flat surface portion of said peripheral cam surface, at said one end is disposed out of contact with said carousel, thereby allowing rotation of said carousel relative to said dispensing opening in said hopper, and an extended position in which said locking pin, at said opposite end being engaged with said cylindrical surface portion of said peripheral cam surface, at said one end is disposed in contact with said carousel, thereby preventing rotation of said carousel relative to said dispensing opening in said hopper.

* * * * *